US010407969B2

(12) United States Patent
Xiao et al.

(10) Patent No.: US 10,407,969 B2
(45) Date of Patent: Sep. 10, 2019

(54) AIR-TIGHT DOOR SYSTEM AND AIR-TIGHT DOOR CONTROL METHOD

(71) Applicant: BROADWELL (SHENZHEN) TECHNOLOGY CO., LTD, Shenzhen, Guangdong (CN)

(72) Inventors: Long Xiao, Guangdong (CN); Qin Wang, Guangdong (CN); Feng Yang, Guangdong (CN); Fengtao Liu, Guangdong (CN)

(73) Assignee: BROADWELL (SHENZHEN) TECHNOLOGY CO., LTD., Shenzhen, Guangdong (CN)

( * ) Notice: Subject to any disclaimer, the term of this patent is extended or adjusted under 35 U.S.C. 154(b) by 146 days.

(21) Appl. No.: 15/500,379

(22) PCT Filed: Jul. 27, 2015

(86) PCT No.: PCT/CN2015/085223

§ 371 (c)(1),
(2) Date: Jan. 30, 2017

(87) PCT Pub. No.: WO2016/015615

PCT Pub. Date: Feb. 4, 2016

(65) Prior Publication Data

US 2017/0218679 A1 Aug. 3, 2017

(30) Foreign Application Priority Data

Aug. 1, 2014 (CN) ..... 2014 1 0377128

(51) Int. Cl.
*E05F 15/73* (2015.01)
*E06B 5/10* (2006.01)

(52) U.S. Cl.
CPC ..... *E05F 15/73* (2015.01); *E06B 5/10* (2013.01); *E05F 2015/763* (2015.01);
(Continued)

(58) Field of Classification Search
CPC ..... E05G 5/02; E05Y 2900/132; E05F 15/00; E05F 15/73; E06B 5/10
See application file for complete search history.

(56) References Cited

U.S. PATENT DOCUMENTS 4,481,887 A * 11/1984 Urbano ..... E05G 5/02 109/3
4,586,441 A * 5/1986 Zekich ..... E05G 5/02 109/38

(Continued)

FOREIGN PATENT DOCUMENTS

CN 2471910 1/2002
CN 2644635 9/2004

(Continued)

OTHER PUBLICATIONS

International Search Report for Application Serial No. PCT/CN2015/085223 dated Oct. 29, 2015, English translation included, 8 pages.

*Primary Examiner* — Justin B Rephann
(74) *Attorney, Agent, or Firm* — Hamre, Schumann, Mueller & Larson, P.C.

(57) ABSTRACT

An air-tight door system and a control method therefor. The air-tight door comprises a first door (M1), a second door (M2), a first door detection module (S1, S2, P1), a second door detection module (S3, S4, P2) and a controller (K). The air-tight door control method comprises: the first and second detection modules (S1, S2, P1, S3, S4, P2) detect whether the first door (M1) and the second door (M2) are completely closed; and the controller (K) controls opening and closing of the first door (M1) and the second door (M2) according to whether the first and second doors (M1, M2) are completely closed. The air-tight door system and the control method therefor ensure that at least one door is in the closed state at any time, thereby further improving air-tightness and device safety.

5 Claims, 3 Drawing Sheets

(52) U.S. Cl.
CPC ... *E05F 2015/765* (2015.01); *E05Y 2900/116* (2013.01); *E05Y 2900/132* (2013.01)

(56) References Cited

U.S. PATENT DOCUMENTS 4,656,954 A * 4/1987 Tonali ..... E05G 5/003 109/6
4,665,395 A * 5/1987 Van Ness ..... G07C 9/00111 340/5.25
4,741,275 A * 5/1988 Lewiner ..... G07C 9/00103 109/59 R
5,195,448 A * 3/1993 Sims ..... E05G 5/02 109/31
5,311,166 A * 5/1994 Frye ..... G08B 15/00 109/20
5,473,318 A * 12/1995 Martel ..... G07C 9/00015 340/12.3
5,711,111 A * 1/1998 Nyffenegger ..... E06B 3/90 49/42
5,769,011 A * 6/1998 Daniel ..... E05G 5/02 109/2
5,992,094 A * 11/1999 Diaz ..... E05G 5/02 109/6
6,298,603 B1 * 10/2001 Diaz ..... E05G 5/02 109/3
6,308,644 B1 * 10/2001 Diaz ..... E05G 5/003 109/6
6,472,984 B1 * 10/2002 Risi ..... E05G 5/003 340/540
6,484,650 B1 * 11/2002 Stomski ..... E05G 5/02 109/6
6,543,185 B1 * 4/2003 Borelli ..... E06B 3/90 49/34
8,832,997 B2 * 9/2014 Osann, Jr. ..... E05G 5/003 49/254
9,010,025 B2 * 4/2015 Osann, Jr. ..... E05G 5/003 49/254
2004/0262383 A1 * 12/2004 Zielinski ..... G07C 9/00126 235/382
2008/0244978 A1 * 10/2008 Soyugenc ..... E05G 5/003 49/42
2010/0275530 A1 * 11/2010 Laskowski ..... E04B 2/7453 52/173.1
2011/0289856 A1 * 12/2011 Slagel ..... E04H 1/1205 52/1
2013/0298466 A1 * 11/2013 Osann, Jr. ..... E05G 5/003 49/28
2014/0373761 A1 * 12/2014 Osann, Jr. ..... E05G 5/003 109/6
2015/0253784 A1 * 9/2015 Tehranchi ..... E05F 15/70 318/452
2015/0259965 A1 * 9/2015 Tehranchi ..... E05F 15/70 49/31
2016/0281424 A1 * 9/2016 Grillberger ..... E06B 11/08

FOREIGN PATENT DOCUMENTS

| | | |
|---|---|---|
| CN | 201982134 | 9/2011 |
| CN | 203263872 | 11/2013 |
| CN | 104153692 | 11/2014 |
| CN | 204139902 | 2/2015 |
| EP | 2460966 | 6/2012 |
| JP | H11178943 | 7/1999 |

* cited by examiner

AIR-TIGHT DOOR SYSTEM AND AIR-TIGHT DOOR CONTROL METHOD

FIELD OF THE INVENTION

The present disclosure relates to an air-tight door system, and more particularly relates to an air-tight system applied to a transfer passageway of an building with air-supported membrane structure for a transportation vehicle passing through, and an air-tight door control method.

BACKGROUND OF THE INVENTION

A building with air-supported membrane structure is a building system adopting a air-supported membrane structure as the main structure. The air-supported membrane structure serves as one kind of the wide-span building structure, it adopts a high strength flexible membrane material, and takes advantage of air pressure to support a membrane that covers a wide-span space. The principle is that: the membrane material is fixed to a periphery of a ground foundational structure, an air supplying system is adopted to enable the indoor air pressure to rise up and arrive a preset pressure, causing a roof to generate a pressure difference between the indoor and the outdoor to resist an external force. Because the air pressure is adopted to support without any beams, such that a larger building space which is completely clear can be obtained.

Due to an air-tight requirement, the transportation vehicle passage in the building with air-supported membrane structure generally adopts a two-door system, when one door is opened, the other door should be closed. In the conventional auto-control switch mode, an infrared ranging sensor is adopted to serve as the sensor detecting the vehicle position. The single chip or PLC is adopted to control the opening and closing of the door. The control logic of the conventional control system is relative simple, because there is no control system which has a better control performance, and the detection sensitivity and accuracy of the sensor will decrease accompanying to the passed time or when it is influenced by the environment, thus the accuracy of the opening and closing of the door will reduce easily or the door will be failed, not only the normal passing of the transportation vehicle is influenced, but also the accident will emerge easily and the air-tightness is influenced. Therefore, the device safety is influenced.

SUMMARY

Accordingly, it is necessary to provide an air-tight door system having an improving device safety and an air-tight door control system.

An air-tight door system includes: a first door, a second door, a first door detection module, a second door detection module, and a controller, wherein the first door and the second door forth an air-tight passage therebetween;

wherein the controller is configured to:

open the first door and configure the second door to prohibit opening when the first door detection module detects that there is a transportation vehicle waiting to enter the first door;

close the first door and configure the first door to prohibit opening when the first door detection module detects that the transportation vehicle passes through the first door completely;

unlock the second door and open the second door when the second door detection module detects that the transportation vehicle will depart the second door, and the first door detection module detects that the first door is completely closed;

close the second door when the second door detection module detects that the transportation vehicle passes through the second door completely; and unlock the first door when the second door detection module detects that the second door is completely closed.

An air-tight door control method includes the following steps:

detecting whether there is a transportation vehicle waiting to enter the first door, if yes, opening the first door and configuring the second door to prohibit opening; the first door and the second door are an entrance and an exit of a same air-tight passage;

detecting whether the transportation vehicle passes through the first door completely, if yes, closing the first door and configuring the first door to prohibit opening;

detecting whether the transportation vehicle waits to depart the second door, and detecting whether the first door is completely closed at the same time, if all are yes, unlocking and opening the second door;

detecting whether the transportation vehicle passes through the second door completely, if yes, closing the second door; and detecting whether the second door is completely closed, if yes, unlocking the first door.

In aforementioned air-tight door system and air-tight door control method, by a configuration of prohibit opening, it avoids that vehicles moves toward each other, and two doors open at the same time, vehicles drive inside along opposite sides, which greatly influences a normal passing through. It not only ensures a normal passing through, but also ensures a requirement of air-tightness. By detecting whether the door is completely closed, it ensures that at least one door is closed at any time, thereby enhancing an air-tightness and improving the device safety.

BRIEF DESCRIPTION OF THE DRAWINGS

To illustrate the technical solutions according to the embodiment of the present invention or in the prior art more clearly, the accompanying drawings for describing the embodiment or the prior art are introduced briefly in the following. Apparently, the accompanying drawings in the following description are only some embodiment of the present invention, and persons of ordinary skill in the art can derive other drawings from the accompanying drawings without creative efforts.

DETAILED DESCRIPTION OF THE EMBODIMENTS

Embodiment of the invention are described more fully hereinafter with reference to the accompanying drawings, in which preferred embodiment of the invention are shown. The various embodiment of the invention may, however, be embodied in many different forms and should not be construed as limited to the embodiment set forth herein. Rather, these embodiment are provided so that this disclosure will be thorough and complete, and will fully convey the scope of the invention to those skilled in the art.

Unless otherwise defined, all tell is used herein have the same meaning as commonly understood by one of ordinary skill in the art to which this invention belongs. Terms in the description of the invention are for the purpose of describing specific embodiment, and are not intend to limit the invention. As used herein, the term "and/or" includes any and all combinations of one or more of the associated listed items The specific embodiment of the present disclosure is fully conveyed with reference to the following figures.

Figure 1:
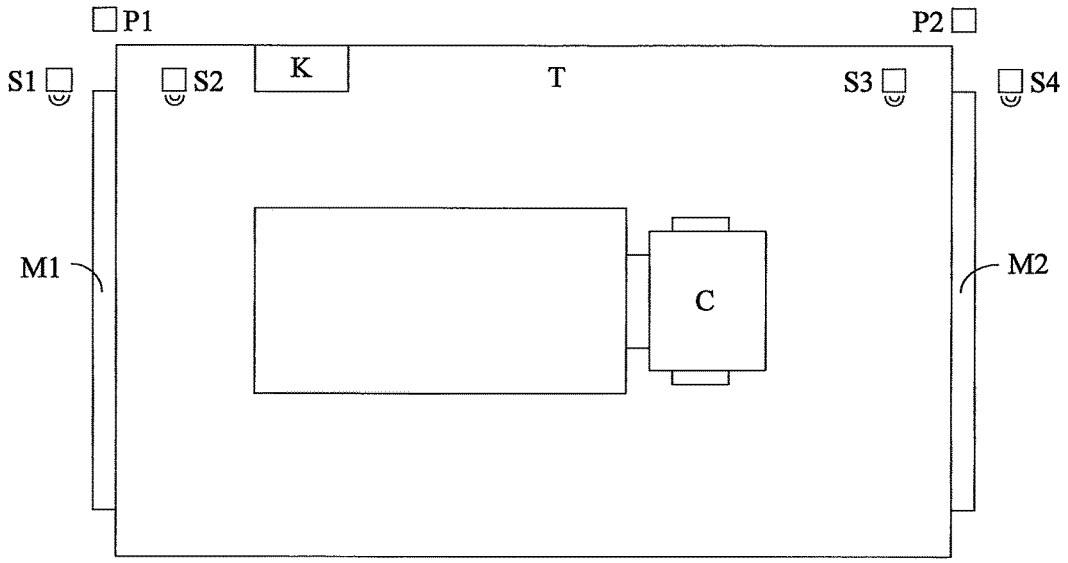
FIG. 1 is a schematic view of an air-tight door system according to one embodiment.

FIG. 1 is a schematic view of an air-tight door system according to one embodiment.

Referring to FIG. 1, an air-tight door system includes a first door M1, a second door M2, a first door inside detection mechanism S2 located inside the first door M1, a first door outside detection mechanism S1 located outside the first door M1, a first door closing detection mechanism P1, a second door inside detection mechanism S3 located inside the second door M2, a second door outside detection mechanism S4 located outside the second door M2, a second door closing detection mechanism P2, and a controller K. A air-tight passage T is formed between the first door M1 and the second door M2. In the following description, "inside door" and "outside door" are speaking relative to the air-tight passage T. The air-tight passage T permits a truck to pass through.

In the illustrated embodiment, the first door inside detection mechanism S2, the first door outside detection mechanism S1, the second door inside detection mechanism S3, and the second door outside detection mechanism S4 are ultrasonic ranging sensors. In an alternative embodiment, they can be infrared ranging sensors, radar raging sensors, or laser sensors.

The first door closing detection mechanism P1 and the second door closing detection mechanism P2 are configured to detect door closing signals of the first door M1 and the second door M2. If only the doors are completely closed, the first door closing detection mechanism P1 and the second door closing detection mechanism P2 send door closing signals to the controller K.

A transportation vehicle C moves from left to right, and arrives the first door M1. The first door outside detection mechanism Si is configured to detect whether there is a transportation vehicle C waiting to enter the first door M1, if yes, the controller K is configured to open the first door M1 and configures the second door M2 to prohibit opening. When the first door outside detection mechanism S1 detects that there is a transportation vehicle C arriving outside the first door M1, which shows that there may be a transportation vehicle C needs to pass through the air-tight passage T. The prohibit opening has a higher priority, even if the second door outside detection mechanism S4 detects that there is a transportation vehicle C arriving the second door M2, a door opening action cannot be generated.

In order to avoid an erroneous judgment, in an alternative embodiment, the first door outside detection mechanism S1 is further configured to detect whether there is an erroneous approaching. When the first door outside detection mechanism S1 detects that there is a transportation vehicle C arriving the first door M1, the first door outside detection mechanism S1 can retard for a preset time duration (5 seconds etc.) and then detects again. If it still detects that there is a transportation vehicle C outside the first door M1, it shows that the transportation vehicles C is waiting to enter the first door M1. The controller K opens the first door M1 again and configures the second door M2 to prohibit opening.

Although it can retard for a present time and then detects again, however, an erroneous judgment may still emerge due to a long remaining time of an inference object. In order to further avoid the erroneous judgment, when the first door outside detection mechanism S1 detects a signal indicating that there is a transportation vehicle C arriving outside the first door M1, the controller K closes the first door M1 and configures the second door M2 to prohibit opening, and the first door outside detection mechanism S1 continues to detect. If it detects that the signal is disappeared (i.e. it detects that there is no transportation vehicle C arriving outside the first door M1), and the first door inside detection mechanism S2 does not detect that there is a transportation vehicle C arriving inside the first door M1 for a predetermined time period, it can be determined that there is an erroneous approaching. At the time, the controller K closes the opened first door M1 and unlocks the second door M2 which is configured to prohibit opening.

The transportation vehicle C passes through the first door M1, the first door inside detection mechanism S2 is configured to detect whether the transportation vehicle C passes through the first door M1 completely, if yes, the controller K is configured to close the first door M1 and configures the first door M1 to prohibit opening. When the first door inside detection mechanism S2 detects that a signal indicating the transportation vehicle C inside the first door M1 is disappeared, it indicates that the transportation vehicle C passes through the first door M1 completely. Or, the first door inside detection mechanism S2 detects that a signal indicating the transportation vehicle C inside the first door M1 is disappeared, and at the same time the first door outside detection mechanism S1 does not detect a signal (i.e. the transportation vehicle C does not go back), it indicates that the transportation vehicle C passes through the first door M1 completely. Thus, the first door M1 can be closed and the first door M1 is configured to prohibit opening. It not only avoids an accident, but also ensures an air-tightness, and improves a device safety.

The transportation vehicle C moves towards the second door M2 through the air-tight passage T. The second door inside detection mechanism S3 is configured to detect whether the transportation vehicle C arrives the second door M2. At the same time, the first door closing detection mechanism P1 is configured to detect whether the first door M1 is completely closed. If yes, the controller K is configured to unlock the second door M2 and opens the second door M2. When the transportation vehicle C arrives the inner side of the second door M2, after ensuing that the first door M1 is completely closed, the second door M2 is then unlocked and opened. It not only avoids an accident, but also ensures an air-tightness, and improves a device safety.

The transportation vehicle C passes through the second door M2. The second door outside detection mechanism S4 is configured to detect whether the transportation vehicle C passes through the second door M2 completely, if yes, the controller K is configured to close the second door M2. Then the second door closing detection mechanism P2 is configured to detect whether the second door M2 is completely closed, if yes, the controller K unlocks the first door M1. After the second door M2 is opened, when the second door outside detection mechanism S4 detects that a signal indicating the transportation vehicle C outside the second door M2 is disappeared, it indicates that the transportation vehicle C passes through the second door M2 completely, at the time, the second door M2 can be closed. When the second door closing detection mechanism P2 detects that the second door M2 is completely closed, the controller K then unlocks the first door M1. It not only avoids an accident, but also ensures an air-tightness, and improves a device safety.

Referring to FIG. 1, it can be understood that, when the transportation vehicle C moves from right to left, at the time, M2 represents the first door, M1 represents the second door, S3 represents the first door inside detection mechanism, S4 represents the first door outside detection mechanism, P2 represents the first door closing detection mechanism, S2 represents the second door inside detection mechanism, S1 represents the second door outside detection mechanism, and P1 represents the second door closing detection mechanism.

The aforementioned air-tight door system can be applied to a transfer passageway of a building with air-supported membrane structure or other places which requires a high air-tightness, for a transportation vehicle passing through. It can be applied to an exit, or an entrance alone, and also can be applied to both the entrance and the exit.

Figure 2:
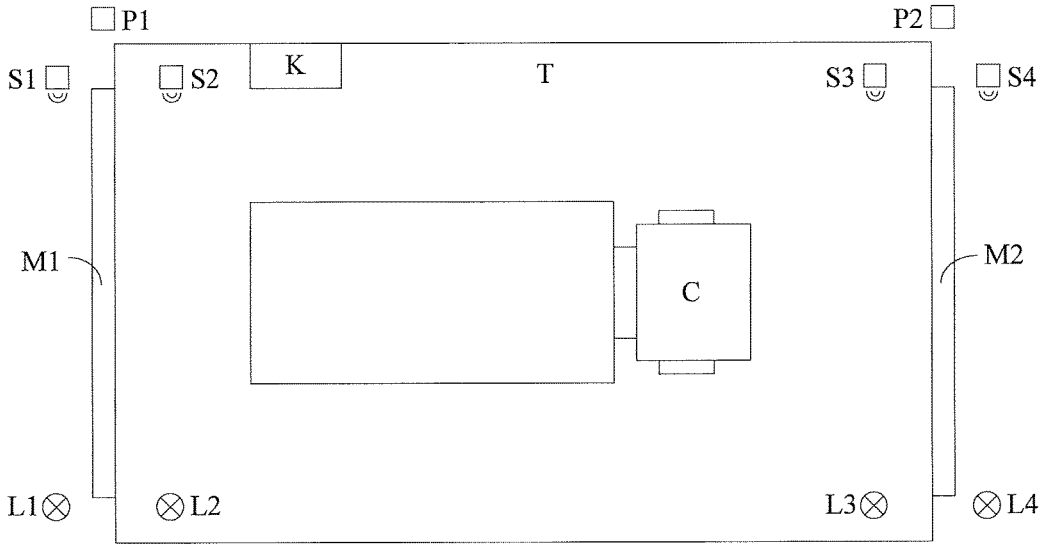
FIG. 2 is a schematic view of an air-tight door system according to another one embodiment.

FIG. 2 is a schematic view of an air-tight door system according to another one embodiment.

An air-tight door system includes a first door M1, a second door M2, a first door inside detection mechanism S2, a first door outside detection mechanism S1, a first door closing detection mechanism P1, a first door inside prompt mechanism L2, a first door outside prompt mechanism L1, a second door inside detection mechanism S3, a second door outside detection mechanism S4, a second door closing detection mechanism P2, a second door inside prompt mechanism L3, a second door outside prompt mechanism L4, and a controller K. An air-tight passage T is formed between the first door M1 and the second door M2. The air-tight passage T permits a truck to pass through.

In the illustrated embodiment, the first door inside detection mechanism S2, the first door outside detection mechanism S1, the second door inside detection mechanism S3, and the second door outside detection mechanism S4 are ultrasonic ranging sensors. In an alternative embodiment, they can also be infrared ranging sensors, radar raging sensors, or laser sensors.

The first door closing detection mechanism P1 and the second door closing detection mechanism P2 are configured to detect door closing signals of the first door M1 and the second door M2, respectively. If only the doors are completely closed, the first door closing detection mechanism P1 and the second door closing detection mechanism P2 will send the door closing signals to the controller K.

In the illustrated embodiment, the first door inside prompt mechanism L2, the first door outside prompt mechanism L1, the second door inside prompt mechanism L3, and the second door outside prompt mechanism L4 all are red-green bi-color indicator lamp, and all will light out when in a standby state. In an alternative embodiment, they can be other indicator lamps, or voice prompt mechanisms, or an indicator lamp additionally equipped with a voice prompt mechanisms.

A transportation vehicle C moves from left to right and arrives outside the first door M1. The first door outside detection mechanism S1 is configured to detect whether there is a transportation vehicle C waiting to enter the first door M1, if yes, the controller K is configured to open the first door M1 and configures the second door M2 to prohibit opening. The first door outside prompt mechanism L1 sends a prompt waiting signal which is represented by showing a constant red light. The second door outside prompt mechanism L4 sends an outside avoidance signal until the second door closing detection mechanism P2 detect that the second door M2 is opened and then completely closed. The outside avoidance signal is represented by twinkling a red light. Apparently, in an alternative embodiment, the second door outside prompt mechanism L4 can also be sending an entering forbidding signal, when the second door outside detection mechanism S4 detects that a transportation vehicle approaches, and then the outside door avoidance signal is sent.

When the first door outside detection mechanism S1 detects that there is a transportation vehicle C arriving outside the first door M1, it indicates that there may be a transportation vehicle needs to pass through the air-tight passage T. The prohibit opening has a higher priority, at the time, even if the second door outside detection mechanism S4 detects that there is a transportation vehicle C arriving the second door M2, a door opening action cannot be generated.

In order to avoid an erroneous judgment, in an alternative embodiment, the first door outside detection mechanism S1 is further configured to detect whether there is an erroneous approaching. When the first door outside detection mechanism S1 detects that there is a transportation vehicle C arriving outside the first door M1, the first door outside detection mechanism S1 can retard for a preset time duration (5 seconds etc.) and then detects again. If it still detects that there is a transportation vehicle C outside the first door M1, it shows that the transportation vehicles C is waiting to enter the first door M1. The first door M1 is then opened and the second door M2 is configured to prohibit opening. The second door outside prompt mechanism L4 sends an outside door avoidance signal.

Although it can retard for a present time and then detects again, however, an erroneous judgment may still emerge due to a long remaining time of an inference object. In order to further avoid the erroneous judgment, when the S1 detects a signal indicating that there is a transportation vehicle C arriving outside the first door M1, the controller K closes the first door M1 and configures the second door M2 to prohibit opening, and the first door outside detection mechanism S1 continues to detect. If it detects that the signal is disappeared (i.e. it detects that there is no transportation vehicle C arriving outside the first door M1), and first door inside detection mechanism S2 does not detect that there is a transportation vehicle C arriving inside the first door M1, at the time, it can be determined that there is an erroneous approaching. At the time, the controller K closes the opened first door M1 and unlocks the second door M2 which is configured to prohibit opening. The second door outside prompt mechanism L4 then sends an outside door avoidance signal.

After the first door M1 is opened, the first door closing detection mechanism P1 detects that the first door M1 is completely opened, the first door outside prompt mechanism L1 sends a prompt passing signal, which is presented by showing a constant green light. After that, when the first door outside detection mechanism S1 detects that the transportation vehicle C passes through the first door M1 completely (the detection signal is disappeared). The first door outside prompt mechanism L1 sends an entering forbidding signal, which is represented by showing a constant red light. The second door inside prompt mechanism L3 sends a prompt passing signal, which is represented by showing a constant green light.

The transportation vehicle C passes through the first door M1, the first door inside detection mechanism S2 is configured to detect whether the transportation vehicle C passes through the first door M1 completely, if yes, the controller K is configured to close the first door M1 and configures the first door M1 to prohibit opening. The first door outside prompt mechanism L1 continues to send an entering forbidding signal, which is represented by showing a constant red light. The second door inside prompt mechanism L3 sends a prompt speed reducing signal, which is represented by twinkling a red light. When the first door inside detection mechanism S2 detects that a signal indicating the transportation vehicle C inside the first door M1 is disappeared, it indicates that the transportation vehicle C passes through the first door M1 completely. Or, when the first door inside detection mechanism S2 detects that a signal indicating the transportation vehicle C inside the first door M1 is disappeared, and at the time the first door outside detection mechanism S1 does not detect a signal (i.e. the transportation vehicle C does not go back), it indicates that the transportation vehicle C passes through the first door M1 completely. At the same time, the first door M1 can be closed and the first door M1 is configured to prohibit opening. It not only avoids an accident, but also ensures an air-tightness, and improves a device safety.

The transportation vehicle C moves towards the second door M2 through the air-tight passage T. When the second door inside detection mechanism S3 detects that the transportation vehicle C arrives the inner side of the second door M2, the second door inside prompt mechanism L3 sends a prompt waiting signal, which is represented by showing a constant red light.

The second door inside detection mechanism S3 is configured to detect whether the transportation vehicle C arrives the second door M2, at the same time, the first door closing detection mechanism P1 is configured to detect whether the first door M1 is completely closed, if yes, the controller K is configured to unlock the second door M2 and opens the second door M2. After the controller K opens the second door M2, when the second door closing detection mechanism P2 detects that the second door M2 is completed opened, the second door inside prompt mechanism L3 sends a prompt passing signal, which is represented by showing a constant green light. When the transportation vehicle C arrives the inner side of the second door M2, after ensuring the first door M1 is completely closed, and then the second door M2 is unlocked and is opened. It not only avoids an accident, but also ensures an air-tightness, and improves a device safety.

The transportation vehicle C passes through the second door M2, the second door outside detection mechanism S4 is configured to detect whether the transportation vehicle C passes through the second door M2 completely, if yes, the controller K is configured to close the second door M2. Then the second door closing detection mechanism P2 is configured to detect whether the second door M2 is completely closed, if yes, the controller K unlocks the first door M1. The first door outside prompt mechanism L1, the second door inside prompt mechanism L3, and the second door outside prompt mechanism L4 all send a standby signal, which is represented by lighting off. After the second door M2 is opened, when the second door outside detection mechanism S4 detects that a signal indicating the transportation vehicle C outside the second door M2 is disappeared, it indicates that the transportation vehicle C passes through the second door M2 completely, and at the time the second door M2 can be closed. After the second door closing detection mechanism P2 detects that the second door M2 is completely closed, the controller K can therefore unlocks the first door M1. It not only avoids an accident, but also ensures an air-tightness, and improves a device safety Referring to FIG. 2, it can be understood that, when the transportation vehicle C moves from right the left, M2 represents the first door, M1 represents the second door, S3 represents the first door inside detection mechanism, S4 represents the first door outside detection mechanism, P2 represents the first door closing detection mechanism, S2 represents the second door inside detection mechanism, S1 represents the second door outside detection mechanism, P1 represents the second door closing detection mechanism, L3 represents the first door inside prompt mechanism, L4 represents a first door outside prompt mechanism, L2 represents the second door inside prompt mechanism, and L1 represents the second door outside prompt mechanism.

The aforementioned air-tight door system can be applied to a transfer passageway of a building with air-supported membrane structure or other places which requires a high air-tightness, for a transportation vehicle passing through. It can be applied to an exit, or an entrance (the first door inside prompt mechanism can be omitted) alone, and also can be applied to both the entrance and the exit.

An air-tight door control method is illustrated in the following text. The method includes the following steps:

In step S110, whether there is a transportation vehicle waiting to enter the first door is detected, if yes, the step S120 is executed, if not, the detection is continued. The first door and the second door are an entrance and an exit of a same air-tight passage.

In step S120, the first door is opened and the second door is configured to prohibit opening. In an alternative embodiment, a prompt waiting signal can be sent outside the first door, which is represented by showing a constant red light. An outside door avoidance signal is sent outside the second door until it detects that the second door is opened and then completely closed. The outside door avoidance signal is represented by twinkling a red light. It is apparent that in an alternative embodiment, an entering forbidding signal may be sent outside the second door. When a transportation vehicle is detected to approach outside the second door, the outside door avoidance signal can therefore be sent. The prohibit opening has a higher priority, even if it detects outside the second door that a transportation vehicle arriving the second door, a door opening action also cannot be generated.

In order to avoid an erroneous judgment, in an alternative embodiment, it further detects outside the first door whether there is an erroneous approaching. When it detects outside the first door that there is a transportation vehicle arriving outside the first door, it retards for a preset time duration (5 seconds etc.) and then detects again. If it still detects that there is a transportation vehicle outside the first door, it shows that the transportation vehicle is waiting to enter the first door. The first door is then opened and the second door is configured to prohibit opening. The outside door avoidance signal is then sent outside the second door.

Although it can retard for a present time and then detects again, however, an erroneous judgment may still emerge due to a long remaining time of an inference object. In order to further avoid the erroneous judgment, when it detects outside the first door that a signal indicating that there is a transportation vehicle arrives outside the first door, the first door is closed and the second door is configured to prohibit opening, and then it continues to detect outside the first door. If it detects that the signal is disappeared (i.e. it detects that there is no transportation vehicle outside the first door), and it does not detect inside the first door that there is a transportation vehicle arriving inside the first door, at the time, it can be determined that there is an erroneous approaching. At the time, the opened first door is closed and the second door which is configured to prohibit opening is unlocked.

In step S130, whether the transportation vehicle passes through the first door completely is detected, if yes, the step S140 is executed, if not, the detection is continued.

In an alternative embodiment, prior to the step S130, the following steps can be further included: after the first door is opened, when it detects that the first door is completely opened, it sends outside the first door a prompt passing signal, which is presented by showing a constant green light. After that, when it detects outside the first door that the transportation vehicle passes through the first door completely (the detection signal is disappeared), it sends outside the first door an entering forbidding signal, which is represented by showing a constant red light. It sends inside the second door a prompt passing signal, which is represented by showing a constant green light.

In step S140, the first door is closed and the first door is configured to prohibit opening. In an alternative embodiment, it continues to send outside the first door an entering forbidding signal, which is represented by showing a constant red light. It sends inside the second door a prompt speed reducing signal, which is represented by twinkling a green light.

In step S150, it detects whether the transportation vehicle waits to depart the second door, and at the same time, it detects whether the first door is completely closed, if all are yes, the step S160 is executed; if all are not, the detection is continued.

In step S160, the second door is unlocked and opened. In an alternative embodiment, it sends inside the second door a prompt waiting signal, which is represented by showing a constant red light.

In an alternative embodiment, after the second door is opened, when it detects that the second door is completely opened, it can send inside the second door a prompt passing signal, which is represented by showing a constant green light. When the transportation vehicle arrives the inner side of the second door, after ensuring that the first door is completely closed, and then the second door is unlocked and is opened. It not only avoids an accident, but also ensures an air-tightness, and improves a device safety.

In step S170, it detects whether the transportation vehicle passes through the second door completely, if yes, the step S180 is executed, if not, the detection is continued. It detects outside the second door whether the transportation vehicle passes through the second door completely.

In step S180, the second door is closed.

In step S190, it detects whether the second door is completely closed, if yes, the step S200 is executed; if not, the detection is continued.

In step S200, the first door is unlocked. In an alternative embodiment, it can also send outside the first door, inside the second door, and outside the second door, a standby signal which is represented by lighting off. After the second door is opened, when the second door outside detection mechanism detects that a signal indicating the transportation vehicle outside the second door is disappeared, it indicates that the transportation vehicle passes though the second door completely, and at the time, the second door can be closed. After the second door closing mechanism detects that the second door is completely closed, the controller can therefore unlocks the first door. It not only avoids an accident, but also ensures an air-tightness, and improves a device safety.

The aforementioned air-tight door control method can be applied to a transfer passageway of a building with air-supported membrane structure or other places which requires a high air-tightness, for a transportation vehicle passing through. It can be applied to an exit, or an entrance alone, and can also be applied to both the entrance and the exit. By a configuration of prohibit opening, it avoids that vehicles moves toward each other, and two doors open at the same time, vehicles drive inside along opposite sides, which greatly influences a normal passing through. It not only ensures a normal passing through, but also ensures a requirement of air-tightness. By detecting whether the door is completely closed, it ensures that at least one door is closed at any time, thereby enhancing an air-tightness and improving the device safety.

Figure 3:
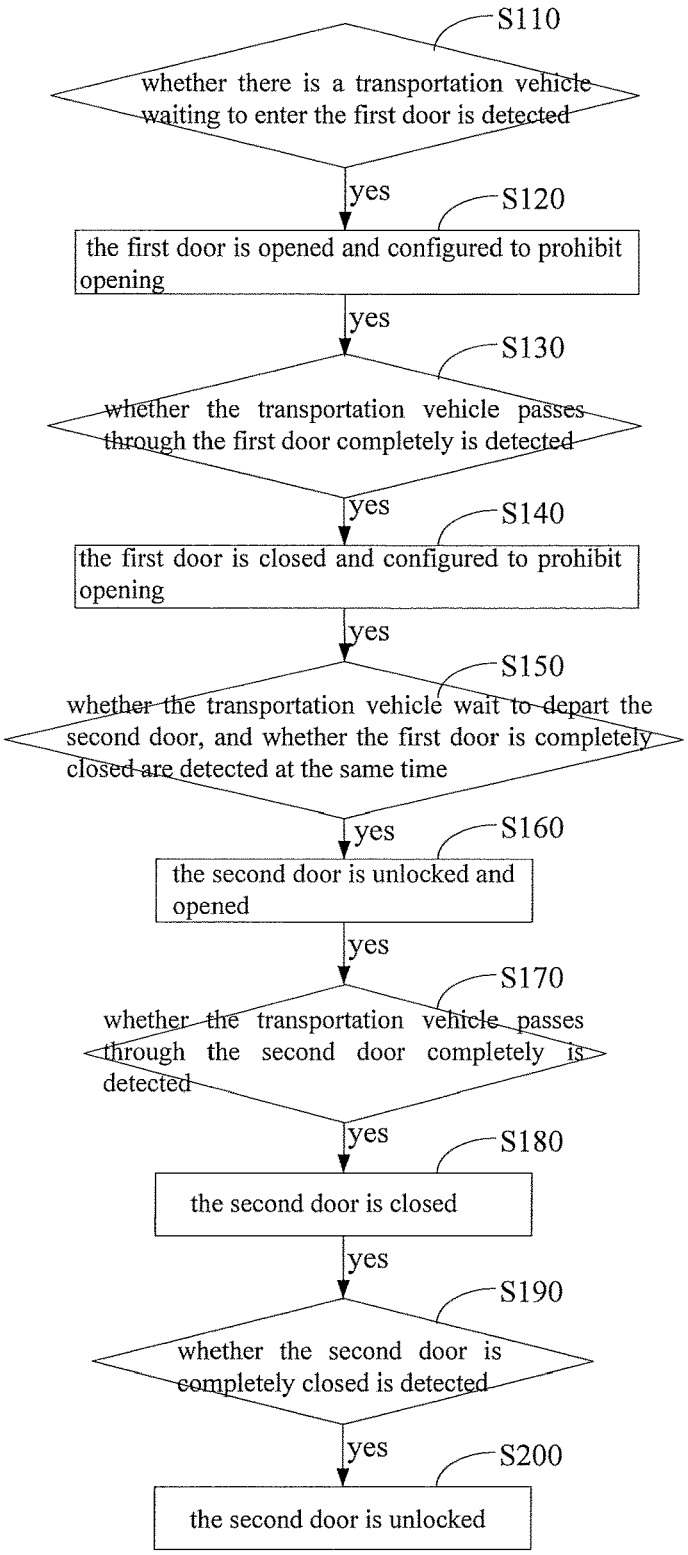
FIG. 3 is a flow chart of an air-tight door control method according to one embodiment.

Understandably, although each step displayed in sequence according to the arrows in the flow chart of FIG. 3, these steps is not necessarily to be executed in sequence according to the arrows. Unless there is specific explanation in the disclosure, there is no strict limit to the execution sequence of these steps, they can be executed by the other sequence. Furthermore, at least a part of steps in the FIG. 3 can include multiple sub-steps or multiple stages, these sub-steps or stages are necessarily to be executed at a same time, they can be executed at different time, and their execution sequence are not necessarily to be executed in sequence, they can be executed in turn with the other steps, sub-steps of the other steps or at least a part of stages.

The above are several embodiment of the present invention described in detail, and should not be deemed as limitations to the scope of the present invention. It should be noted that variations and improvements will become apparent to those skilled in the art to which the present invention pertains without departing from its spirit and scope. Therefore, the scope of the present invention is defined by the appended claims.

What is claimed is:

1. An air-tight door system, comprising: a first door, a second door, a first door detection module, a second door detection module, a controller, and a passage between the first door and the second door, wherein when the first door and the second door are closed, the passage is air-tight;

wherein the controller is configured to:

open the first door and configure the second door to prohibit opening when the first door detection module detects that there is a transportation vehicle waiting to enter the passage through the first door;

close the first door and configure the first door to prohibit opening when the first door detection module detects that the transportation vehicle passes through the first door completely; unlock the second door and open the second door when the second door detection module detects that the transportation vehicle will depart the passage through the second door, and the first door detection module detects that the first door is completely closed;

close the second door when the second door detection module detects that the transportation vehicle passes through the second door completely;

unlock the first door when the second door detection module detects that the second door is completely closed;

close the opened first door and unlock the second door when a signal indicating that the transportation vehicle is outside the first door is detected by the first door detection module, and the signal ceases without detection by the first door detection module of a signal indicating that the transportation vehicle has entered the passage through the first door.

2. The air-tight door system according to claim 1, wherein the first door detection module comprises a first door inside detection mechanism, a first door outside detection mechanism, and a first door closing detection mechanism, the first door inside detection mechanism is configured to detect whether the transportation vehicle is located at the inner side of the first door, the first door outside detection module is configured to detect whether the transportation vehicle is located outside the passage and adjacent to the first door, and the first door closing detection mechanism is configured to detect whether the first door is completely closed.

3. The air-tight door system according to claim 1, wherein the second door detection module comprises a second door inside detection mechanism, a second door outside detection mechanism, and a second door closing detection mechanism, the second door inside detection mechanism is configured to detect whether the transportation vehicle is located inside the passage and adjacent to the second door, the second door outside detection mechanism is configured to detect whether the transportation vehicle is located outside the passage and adjacent to the second door, the second door closing detection mechanism is configured to detect whether the second door is completely closed.

4. The air-tight door system according to claim 1, wherein the first door detection module and/or the second door detection module comprise a sensor selected from the group consisting of an infrared ranging sensor, an ultrasonic ranging, a radar ranging sensor, or a laser sensor.

5. An air-tight door control method, comprising the following steps: detecting whether there is a transportation vehicle waiting to enter a first door, opening the first door and configuring a second door to prohibit opening when the transportation vehicle is detected waiting to enter the first door; the first door and the second door being an entrance and an exit of a passage, wherein the passage is air-tight when the first door and the second door are closed;

detecting whether the transportation vehicle passes through the first door and into the passage completely, and when the transportation vehicle has passed through the first door, closing the first door and configuring the first door to prohibit opening;

detecting whether the transportation vehicle waits to depart the passage through the second door, and detecting whether the first door is completely closed at the same time, when both the transportation vehicle waits to depart and the first door is completely closed, unlocking and opening the second door;

detecting whether the transportation vehicle passes through the second door completely, and when the transportation vehicle has passed through the second door completely, closing the second door;

detecting whether the second door is completely closed, when the second door is completely closed, unlocking the first door, and closing the first door and unlocking the second door when a signal indicating that a transportation vehicle is waiting to enter the first door is detected and the signal ceases without detection of the transportation vehicle passing through the first door completely.

* * * * *